US008398128B2

(12) United States Patent
Arabia et al.

(10) Patent No.: US 8,398,128 B2
(45) Date of Patent: Mar. 19, 2013

(54) VEHICLE DOOR LATCH SYSTEM

(75) Inventors: Frank J. Arabia, Macomb, MI (US); Xinhua He, Zionsville, IN (US); Todd A. Suddon, Clarkston, MI (US); Joseph D. Long, Waterford, MI (US); Thomas A. Dzurko, El Paso, TX (US)

(73) Assignee: Inteva Products, LLC, Troy, MI (US)

( * ) Notice: Subject to any disclaimer, the term of this patent is extended or adjusted under 35 U.S.C. 154(b) by 791 days.

(21) Appl. No.: 12/210,684

(22) Filed: Sep. 15, 2008

(65) Prior Publication Data

US 2009/0230700 A1 Sep. 17, 2009

Related U.S. Application Data

(60) Provisional application No. 60/972,453, filed on Sep. 14, 2007.

(51) Int. Cl.
*E05C 3/06* (2006.01)
*E05C 3/16* (2006.01)

(52) U.S. Cl. ..... 292/216; 292/1; 292/93; 292/201; 292/DIG. 22; 292/DIG. 65

(58) Field of Classification Search ..... 49/503; 292/216, 93, 1, DIG. 22, DIG. 65, 201; 70/254, 70/248, 255
See application file for complete search history.

(56) References Cited

U.S. PATENT DOCUMENTS 2,726,075 A * 12/1955 Hosford ..... 73/510
4,756,563 A 7/1988 Garwood et al.
5,054,827 A 10/1991 Konchan et al.
5,277,461 A 1/1994 Dzurko et al.
5,308,130 A 5/1994 Lee
5,454,608 A 10/1995 Dzurko et al.
5,669,642 A * 9/1997 Kang ..... 292/336.3
5,865,481 A * 2/1999 Buschmann ..... 292/216
6,040,638 A * 3/2000 Howell ..... 307/10.2
6,053,543 A 4/2000 Arabia, Jr. et al.
6,256,932 B1 * 7/2001 Jyawook et al. ..... 49/503
6,279,972 B1 * 8/2001 Brill et al. ..... 292/216
6,310,411 B1 * 10/2001 Viallet ..... 307/125

(Continued)

FOREIGN PATENT DOCUMENTS

EP 1279784 A1 * 1/2003
IT EP 1279784 * 1/2003

OTHER PUBLICATIONS

Written Opinion dated Apr. 6, 2009 for International Application No. PCT/US2008/076395, International Filing Date Sep. 15, 2008.

(Continued)

*Primary Examiner* — Carlos Lugo
(74) *Attorney, Agent, or Firm* — Cantor Colburn LLP

(57) ABSTRACT

A vehicle door latch system configured to temporarily prevent door latch mechanisms from unlatching during a predetermined event is provided. The vehicle door latch system includes a forkbolt pivotally mounted to a housing portion of the vehicle door latch. The forkbolt is capable of moving between a latching position and an unlatching position. The door latch system also includes a block out mechanism configured for movement between a blocking position and an unblocking position. The block out mechanism is configured to prevent the forkbolt from moving from the latching position to the unlatching position when the block out mechanism is in the blocking position. A biasing member biases the block out mechanism into the unblocking position. The door latch system also includes an activation mechanism for moving the block out mechanism to the blocking position when the activation mechanism is activated for a predetermined time period to overcome the biasing member and after the predetermined time period, the block out mechanism moves to the unblocking position by the biasing member.

16 Claims, 3 Drawing Sheets

U.S. PATENT DOCUMENTS

| | | | | |
|---|---|---|---|---|
| RE38,338 | E * | 12/2003 | Yoshida et al. | 307/10.2 |
| 6,705,665 | B1 * | 3/2004 | Buecker et al. | 296/146.9 |
| 6,732,516 | B2 * | 5/2004 | Butera et al. | 60/527 |
| 6,871,519 | B2 * | 3/2005 | Butera et al. | 70/256 |
| 6,955,389 | B2 * | 10/2005 | Suzuki et al. | 296/146.4 |
| 7,331,616 | B2 * | 2/2008 | Brei et al. | 292/100 |
| 7,364,211 | B2 * | 4/2008 | Niskanen et al. | 292/336.3 |
| 7,380,843 | B2 * | 6/2008 | Alacqua et al. | 292/163 |
| 7,481,468 | B2 * | 1/2009 | Merideth et al. | 292/137 |
| 7,810,852 | B2 * | 10/2010 | Alacqua et al. | 292/201 |
| 8,056,944 | B2 * | 11/2011 | Jankowski et al. | 292/216 |
| 8,157,300 | B2 * | 4/2012 | Niskanen et al. | 292/216 |
| 8,196,975 | B2 * | 6/2012 | Jankowski et al. | 292/216 |
| 2003/0177974 | A1 * | 9/2003 | Dominique | 116/200 |
| 2005/0062329 | A1 * | 3/2005 | Alacqua et al. | 297/378.12 |
| 2006/0131892 | A1 * | 6/2006 | Pereverzev | 292/216 |
| 2008/0217927 | A1 * | 9/2008 | Browne et al. | 292/28 |
| 2010/0237632 | A1 * | 9/2010 | Browne et al. | 292/201 |
| 2012/0126551 | A1 * | 5/2012 | Alexander et al. | 292/226 |

OTHER PUBLICATIONS

International Search Report dated Apr. 6, 2009 for International Application No. PCT/US2008/076395, International Filing Date Sep. 15, 2008.

* cited by examiner

VEHICLE DOOR LATCH SYSTEM

CROSS REFERENCE TO RELATED APPLICATIONS

This application claims the benefit of the following U.S. Provisional Patent Application, Ser. No. 60/972,453, filed Sep. 14, 2007, the contents of which are incorporated herein by reference thereto.

BACKGROUND

Exemplary embodiments of the present invention relate generally to a vehicle door latch system and more particularly, to a vehicle door latch system configured to keep door latch mechanisms from unlatching during one or more predetermined events.

A vehicle closure, such as a door for a vehicle passenger compartment, is hinged to swing between open and closed positions (e.g., passenger and driver side doors, lift gates, etc.) or slide between an open and closed position along a guide track (e.g., sliding doors for vans) and conventionally includes a door latch that is housed between inner and outer panels of the door. The door latch functions in a well-known manner to latch the door when it is closed and to lock the door in the closed position or to unlock and unlatch the door so that the door can be opened manually or powered.

The door latch is operated remotely from the exterior of the automobile by at least two distinct operators, a key cylinder that controls the lock mechanism and an outside door handle or push button that controls the release mechanism.

The door latch is also operated remotely from inside the passenger compartment by at least two distinct operators, a sill button that controls the lock mechanism and an inside door handle that controls the release mechanism. Vehicle door latches may also include power door locks in which the lock mechanism is motor driven and/or a keyless entry in which a key fob transmitter sends a signal to a receiver in the vehicle to operate a motor driven lock mechanism.

The door latch type noted above operates in a well-known manner. However, there is a desire to make further improvements in door latches of the above noted type, including other variations of door latches that are well known. More specifically, there is a desire to make a door latch system designed to keep door latch mechanisms from unlatching during one or more predetermined events for a predetermined time period. It is also desirable for designing a door latch system that utilizes any or all vehicle sensors allowing the latch mechanism to engage and prevent the latch from mechanically releasing during the predetermined event.

SUMMARY OF THE INVENTION

Thus, in accordance with exemplary embodiments of the present invention there is provided a vehicle door latch system configured to prevent a latch mechanism from unlatching when one or more variables during one or more predetermined events are detected and exceed a locking threshold for a predetermined time period.

In one exemplary embodiment, a vehicle door latch system configured to prevent door latch mechanisms from unlatching during a predetermined event is provided. The door latch generally includes a forkbolt pivotally mounted to a housing portion of the vehicle door latch, the forkbolt being capable of movement between a latching position and an unlatching position. The door latch also includes a block out mechanism configured for movement between a blocking position and an unblocking position, the block out mechanism being configured to prevent the forkbolt from moving from the latching position to the unlatching position when the block out mechanism is in the blocking position, the block out mechanism being biased into the unblocking position by a biasing member. The door latch also includes an activation mechanism for moving the block out mechanism to the blocking position when the activation mechanism is activated for a predetermined time period to overcome the biasing member and after the predetermined time period, the block out mechanism moves to the unblocking position by the biasing member.

In another exemplary embodiment, a method of preventing movement of a forkbolt mounted to a housing portion of a vehicle door latch is provided, the method comprising: biasing a block out mechanism into an unblocking position by a biasing member, the block out mechanism allowing the forkbolt to move between a latching position and an unlatching position when the block out mechanism is in the unblocking position; and moving the block out mechanism into a blocking position for a predetermined time period by temporarily overcoming the biasing member by the activation of an activation mechanism, the block out mechanism being configured to prevent the forkbolt from moving from the latching position to the unlatching position when the block out mechanism is in the blocking position and after the predetermined period of time, the block out mechanism moves to the unblocking position by the biasing member.

In another exemplary embodiment a method of preventing movement of a forkbolt mounted to a housing portion of a vehicle door latch is provided, the method comprising: biasing a block out mechanism into an unblocking position by a biasing member, the block out mechanism allowing the forkbolt to move between a latching position and an unlatching position; detecting the occurrence of at least one variable during at least one predetermined event by at least one sensor; sending a signal to an electronic control module when the at one variable during the at least one predetermined event is detected to activate an activation mechanism, the electronic control module is configured to determine if the at least one variable exceeds a locking threshold, the activation mechanism activates when the electronic control module determines that the at least one variable exceeds the locking threshold; and moving the block out mechanism into a blocking position for a predetermined time period by temporarily overcoming the biasing member when the activation mechanism is activated, the block out mechanism being configured to prevent the forkbolt from moving from the latching position to the unlatching position when the block out mechanism is in the blocking position and after the predetermined period of time, the block out mechanism moves to the unblocking position by the biasing member.

DETAILED DESCRIPTION OF EXEMPLARY EMBODIMENTS

Figure 1:
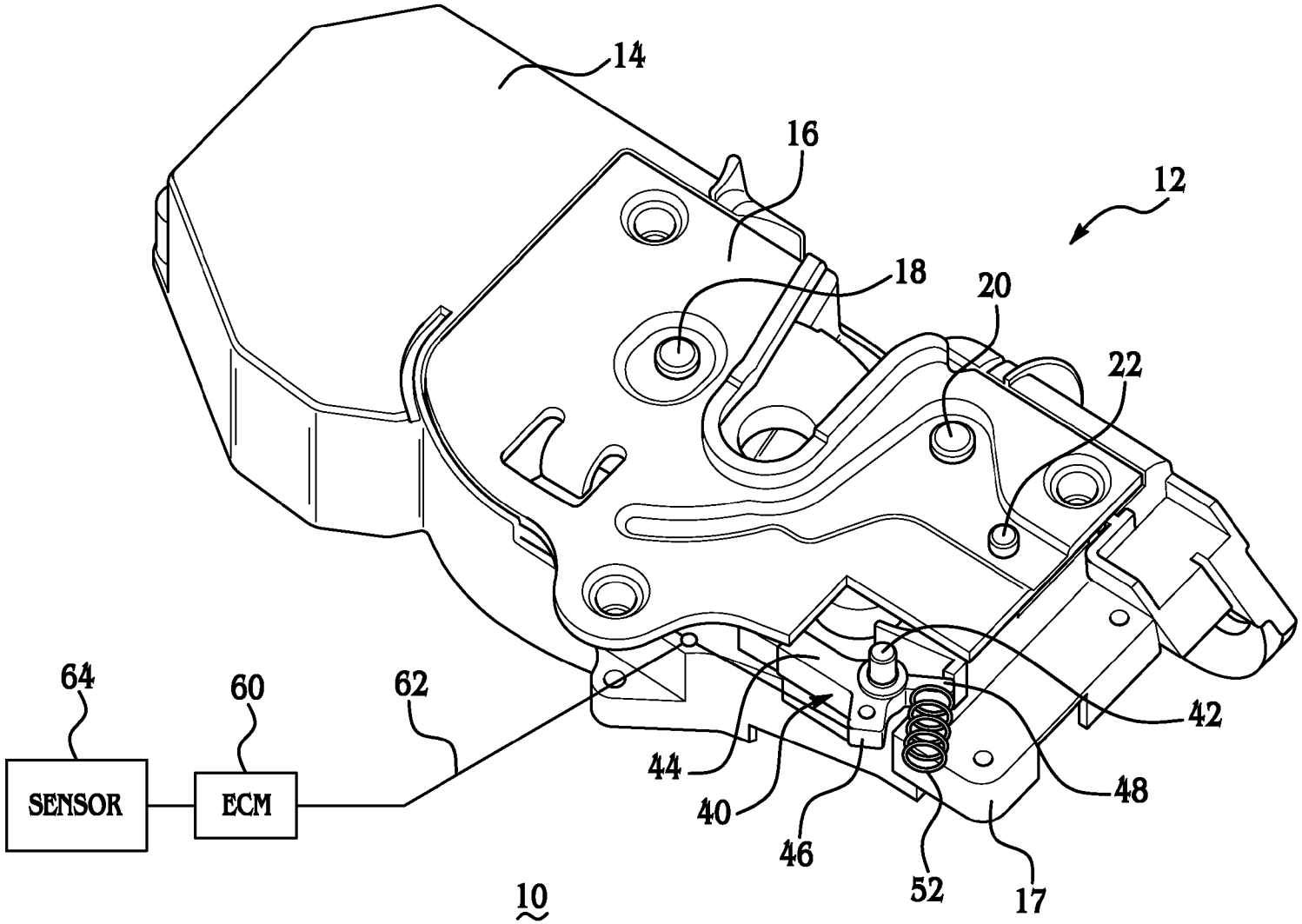
FIGS. 1-2 illustrate a perspective view of an exemplary embodiment of a vehicle door latch system in accordance with an exemplary embodiment of the present invention.

Exemplary embodiments of the present invention are directed to a vehicle door latch system configured to temporarily prevent door latch mechanisms of a door latch from unlatching when one or more variables during one or more predetermined events are detected and exceed a locking threshold. Specifically, the exemplary embodiments of the present invention are directed to a vehicle door latch system configured to temporarily prevent the movement or the unlatching of a forkbolt pivotally mounted to a housing of a vehicle door latch by temporarily preventing the movement or the unlatching of a detent from the forkbolt when one or more variables during one or more predetermined events are detected and exceed a locking threshold. The predetermined events that may occur include, but are not limited to, high inertial loading, G-forces, and linkage activation releases, which are not attributable to normal latch operation (e.g. desired opening and closing). The one or more variables that may be detected include, but are not limited to rapid vehicle acceleration and/or deceleration and deformation of crumple zones in a vehicle.

A vehicle door latch is described in U.S. Pat. No. 5,277,461, the contents of which are incorporated herein by reference thereto. The door latch disclosed in the '461 patent includes an unlatching lever pivotally mounted on a stud that is secured to a metal back plate and a metal face plate at opposite ends. The unlatching lever unlatches the vehicle door by an inside handle lever that is connected by a suitable linkage for rotation by an inside door handle.

The door latch of the '461 patent also includes a locking lever that is pivotally mounted on the stud. The locking lever is operated by an inside locking lever that is pivotally mounted on the flange of the metal face plate near the inside handle lever. The inside locking lever is operated by an inside sill button or lock slide through a suitable linkage. The locking lever is also operated by an outside locking lever that is operated by a key lock cylinder through a suitable linkage. In one exemplary embodiment, the locking lever is power operated by a remotely controlled linear electric motor or the like in a well-known manner.

The door latch disclosed in the '461 patent is unlocked and unlatched in the following sequence. First the locking lever is moved to the unlocked position by the inside locking lever, the outside locking lever, or in the instance of a vehicle equipped with power door locks, a remotely controlled motor. This moves the intermittent lever to the unlocked position. After the door latch is unlocked, the door latch is unlatched by moving the unlatching lever via inside handle lever or outside handle lever to the unlatched position pulling intermittent lever and detent down to unlatch the door lock. The vehicle door then may be pushed or pulled open manually.

U.S. Pat. No. 5,308,130, the contents of which are incorporated herein by reference also discloses a vehicle door latch.

Figure 2:
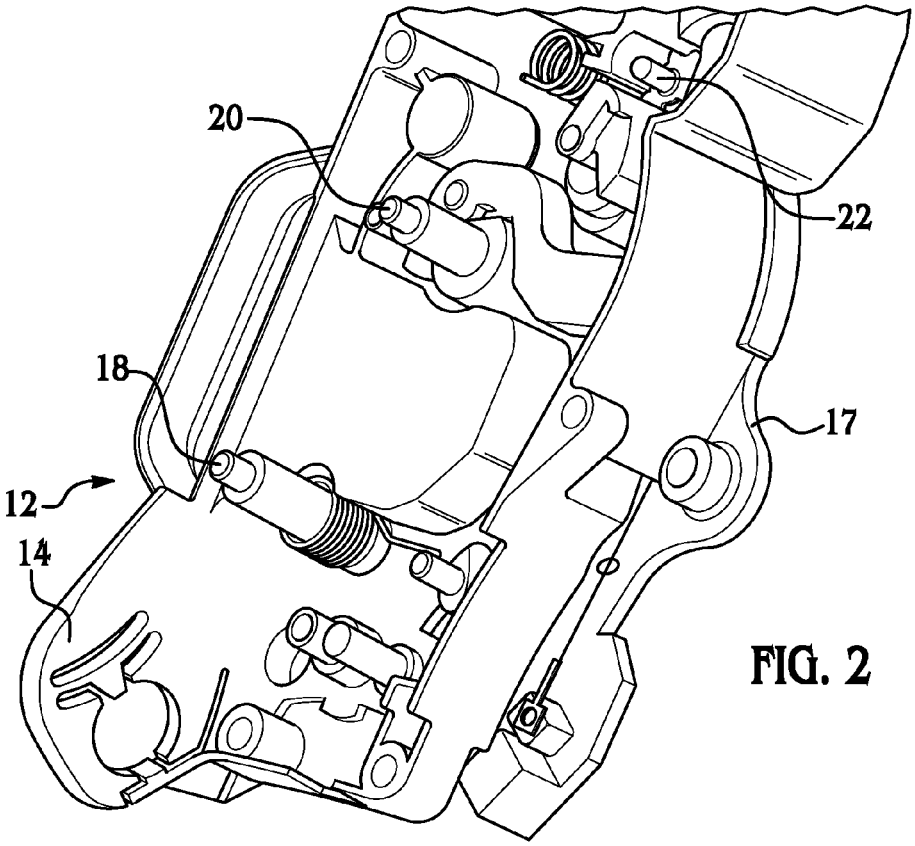

Referring now to FIG. 1, there is illustrated an exemplary embodiment of a vehicle door latch system 10 in accordance with an exemplary embodiment of the present invention. The vehicle door latch system 10 includes a door latch 12. The door latch 12 includes a housing portion 14 for housing the latching mechanisms. The housing portion 14 is formed from an easily molded material such as plastic (e.g. polyurethanes or equivalents thereof). The housing portion 14 includes corresponding slots for receiving a rigid metal frame or face plate 16 and a back cover 17, which in one non-limiting exemplary embodiment is formed from a plastic material, as shown in FIG. 2. The face plate 16 is secured to housing portion 14 by three flanged studs 18, 20, 22. The three flanged studs 18, 20, 22 are inserted through three corresponding holes in back cover 17 and through the interior of housing portion 14, then through three aligned holes in face plate 16 and then flanged over face plate 16 to form a forward compartment.

Figure 3:
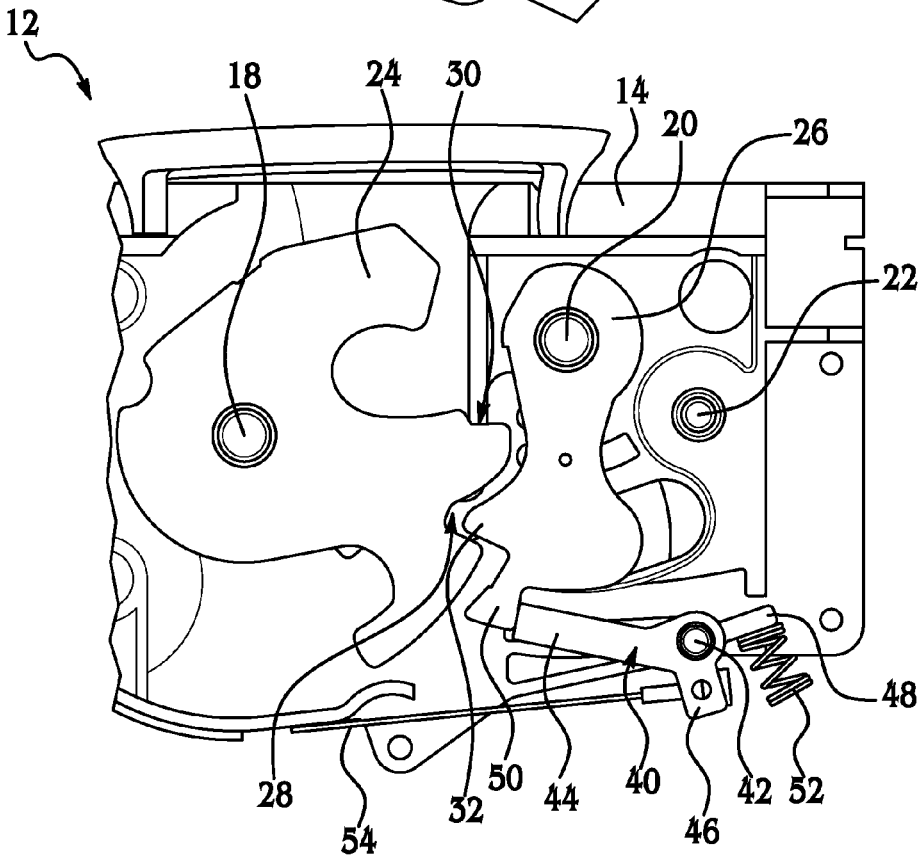
FIG. 3 illustrates a top view of a latch mechanism being in a latched position with a block out mechanism being in an unblocking position in accordance with an exemplary embodiment of the present invention.
Figure 4:
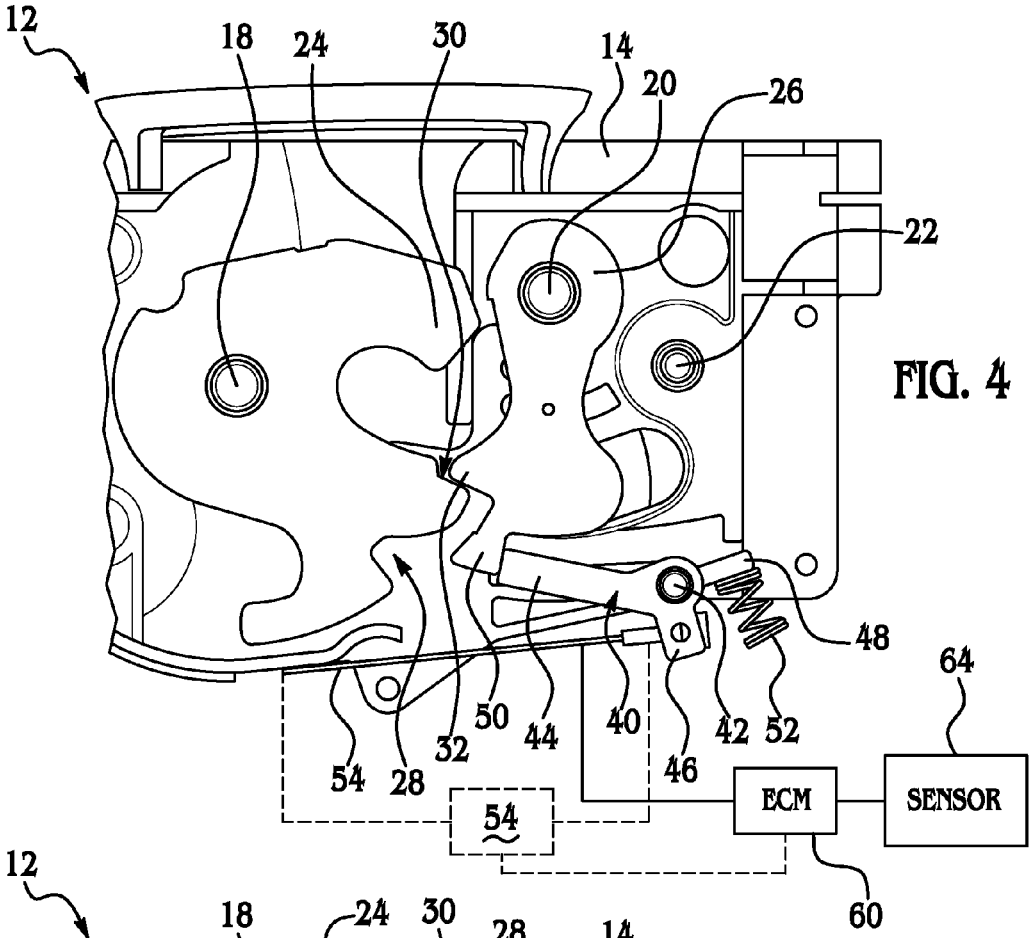
FIG. 4 illustrates a top view of the latch mechanism being in a latched position with the block out mechanism being in a blocking position in accordance with an exemplary embodiment of the present invention.
Figure 5:
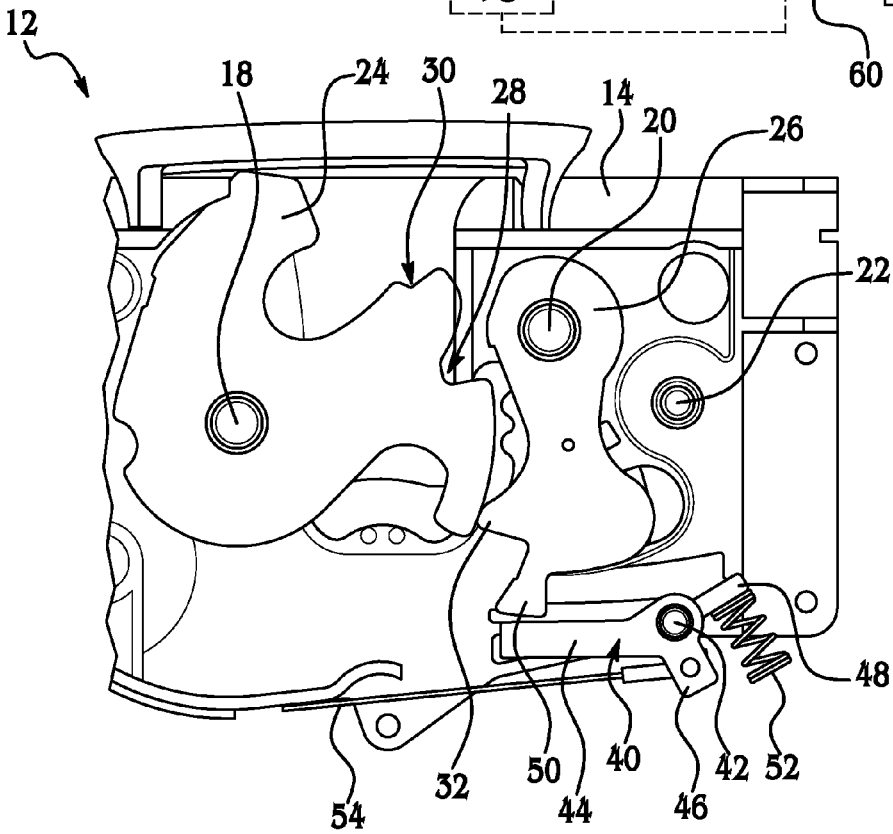
FIG. 5 illustrates a top view of the latch mechanism being in an unlatched positioned with the block out mechanism being in the unblocking position in accordance with an exemplary embodiment of the present invention.

In accordance with an exemplary embodiment, door latch 12 includes a latch mechanism comprising a forkbolt 24 and a cooperating detent 26 that are located in the forward compartment and pivotally mounted on the forward portions of studs 18 and 20 respectively as illustrated in FIG. 3. The forkbolt 24 defines a first shoulder 28 and a second shoulder 30 in which a periphery portion of a contact feature 32 defined by detent 26 cooperatively engages with. Specific details of the structure and operation of forkbolt 24 and cooperating detent 26 are not shown or described because the details are not necessary for an understanding of the exemplary embodiments of present invention except to know that detent 26 is rotated counterclockwise from the unreleasing position and latched engagement with forkbolt 24 at shoulder 28 as illustrated in FIG. 3, or shoulder 30 as illustrated in FIG. 4, to a releasing position and unlatched engagement with the forkbolt 24 as illustrated in FIG. 5 when the latch mechanism is operated. The latter or releasing position of detent 26 allows forkbolt 24 to freely rotate counterclockwise from the latched position shown in FIGS. 3 and 4 to the unlatched position shown in FIG. 5.

The door latch 12 includes a release mechanism (not shown) for releasing or unlatching the latch mechanism as generally described above and a locking mechanism (not shown) for disabling the release mechanism, which are both generally located in the rear compartment defined by housing portion 14. Details of the structure and operation of the release mechanism and the lock mechanism are also not necessary for an understanding of the exemplary embodiments of the present invention except to know the general operation of the latch mechanism as described above. However, for a detailed explanation of a suitable latch mechanism, a release mechanism, and a lock mechanism, that could be used in accordance with an exemplary embodiment of the present invention see U.S. Pat. No. 6,053,543, the contents of which are incorporated herein by reference thereto.

In a non-limiting exemplary embodiment, a block out mechanism 40 is installed within housing portion 14 of door latch 12. As illustrated in FIGS. 3-5, block out mechanism 40 is located in the forward compartment and pivotally mounted on the forward portions of a block out stud 42 that is inserted through a corresponding hole in back plate 17, then through an aligned hole in face plate 16. In one non-limiting exemplary embodiment, block out mechanism 40 is constructed out of plastic materials. Of course, other suitable materials, such as aluminum or steel, or equivalents thereof could be used to construct block out mechanism 40. The block out mechanism 40 generally defines a first arm 44, a second arm 46, and a third arm 48. The first arm 44 extends towards one end of block out mechanism 40, while second arm 46 and third arm 48 extends toward another end of block out mechanism 40. The block out mechanism 40 is configured to move about block out stud 42 from an unblocked position and out of latched engagement with detent 26 to a blocked position and in latched engagement with detent 26. When block out mechanism 40 is moved in the blocked position, a periphery portion of first arm 44 abuts a periphery portion of an ear 50 defined by detent 26 as shown. The block out mechanism 40 operates to temporarily prevent detent 26 from moving from the unreleasing position and disengaging with shoulder 28 or shoulder 30 of forkbolt 24 during one or more predetermined events.

Door latch 12 also includes a block out return spring 52. Still referring to FIGS. 3-5, block out return spring 52 is disposed in a slot configured within housing portion 14. In one non-limiting exemplary embodiment, block out return spring 52 is constructed out of steel. Of course, other suitable spring types or equivalents thereof could be used to construct block out return spring 52. One end of block out return spring 52 engages partly or substantially a surface of third arm 48 of block out mechanism 40 while another end engages an internal wall of housing portion 14. The block out return spring 52 biases block out mechanism 40 counterclockwise to the unblocking position.

In an exemplary embodiment, door latch 12 includes an activation mechanism 54. As illustrated in FIGS. 3-5, activation mechanism 54 is located within housing portion 14. In one exemplary embodiment, one end of activation mechanism 54 is firmly secured to second arm 46 of block out mechanism 40 and the other end of activation mechanism 54 is secured to a portion of the internal wall of housing portion 14. The manner in which one end of activation mechanism 54 is firmly secured to second arm 46 of block out mechanism 32 include, but should not be limited to, stapling, pinning, sticking, or otherwise. Other suitable securing methods include wrapping or tying activation mechanism 54 through a hole formed through second arm 46. The opposite end of activation mechanism 54 can be secured to a portion of the internal wall of housing portion 14 using similar methods described above.

The activation mechanism 54 is configured to temporarily overcome the biasing force of block out return spring 52. This will become more apparent with the details that follow. In one non-limiting exemplary embodiment, activation mechanism 54 is a metal wire composed of one or more alloys having superior deformable properties. Suitable types of materials, such as shape memory alloys for activation mechanism 54 can be constructed out of include, but are not limited to, copper-zinc aluminum alloys, copper-aluminum-nickel alloys, and nickel-titanium alloys. In a preferred embodiment, nickel-titanium alloys are used to construct activation mechanism 54.

The superior deformable properties possessed by activation mechanism 54 allow activation mechanism 54 to deform from one length or its original length to another length less than its original length when a force is applied to activation mechanisms 54. In one exemplary embodiment, activation mechanism 54 deforms from one length to another length when heat is applied directly or indirectly to it or when the temperature of activation mechanism 54 is reduced to a deformable temperature. The activation mechanism 54 begins to deform from its original length to a length less than the original at above its phase transition temperatures. The activation mechanism 54 is configured to return back to its original length upon cooling or below at its phase transition temperature. The length of activation mechanism can be shortened by at least four percent its original length.

When heat deforms activation mechanism 54 to a length less than its original length, the output force, ranging from ones to hundred grams, is temporarily applied to second arm 46 of block out mechanism 40 for a predetermined time period. Of course, the amount of force can vary as required by applications of exemplary embodiments of the present invention. The predetermined time period will depend on the predetected events and the construction of the activation mechanism 54, such as materials, shape, dimensions, and power applied. The output force applied to block out mechanism 40 caused by activating the activation mechanism 54 rotates block out mechanism 40 clockwise and overcomes the biasing force of block out return spring 52 for a predetermined time period. In doing so, block out mechanism 40 is moved in the blocking position for the predetermined time period. During that predetermined time period, contact feature 32 of detent 26 remains engaged with shoulder 28 or shoulder 30 of forkbolt 24. After the predetermined time period, block out mechanism 40 is moved back to the unblocking position. In this instance, detent 26 is free to rotate counterclockwise in the releasing position and remove itself from engagement with shoulder 28 or shoulder 30 of forkbolt 24. This allows forkbolt 24 to freely rotate counterclockwise in the unlatching position.

Referring back to FIG. 1, in an exemplary embodiment, door latch system 10 includes an electronic control module 60. The electronic control module 60 is in electrical communication with activation mechanism 54, via an input line 62. In one exemplary embodiment, electronic control module 60 is located outside housing portion 14 and within the vehicle in which door latch 12 is installed. In an exemplary embodiment, electronic control module 60 includes a processor (not shown) for determining whether or not one or more variables detected during one or more predetermined events exceed a locking threshold and a power source (not shown) that provides voltage to activation mechanism 54 when one or more variables during one or more predetermined events are detected and exceed the locking threshold. When voltage is applied to activation mechanism 54, the activation mechanism 54 in this embodiment is heated and deforms from its original length to a length less than its original as described above.

Still referring to FIG. 1, in an exemplary embodiment, door latch system 10 includes a sensor 64. The sensor 64 is in communication with electronic control module 60. The sensor 64 is configured to send a signal to electronic control module 60 when one or more variables during one or more predetermined events are detected by sensor 64. The signal sent to the electronic control module 60 is representative of the one or more variables. In one non-limiting exemplary embodiment, sensor 64 is an accelerometer capable of detecting the acceleration of the vehicle. However, other sensors configured for measuring or detecting acceleration, vibrations, or otherwise could be used in accordance with an exemplary embodiment of the present invention.

In one exemplary embodiment, sensor 64 is configured to indicate one or more of the predetermined events by detecting one or more variables described above. When one or more variables during one or more predetermined events are detected by sensor 64, sensor 64 sends the signal to electronic control module 60. This activates electronic control module 60 to determine whether or not the one or more variables exceed the locking threshold. If so, the electronic control module 60 provides voltage to activation mechanism 54 for a predetermined time period. The voltage sent to deform activation mechanism 54 ranges from 1 to 120V, typically from 1 to 12V. Once voltage is provided to activation mechanism 54, the length of activation mechanism 54 deforms to a length shorter than its original length for a predetermined time period. During this predetermined time period, activation mechanism 54 temporarily applies output force to second arm 46 of block out mechanism 40, thereby having block out mechanism 40 overcome the biasing force of block out return spring 52. Accordingly, block out mechanism 54 prevents contact feature 32 of detent 26 from disengaging with shoulder 28 or shoulder 30 of forkbolt 24.

It should be understood that electronic control module 60 can be in signal communication with additional sensors, similar or different from sensor 64, that are capable of indicating one or a combination of predetermined events.

In accordance with an exemplary embodiment of the present invention, an exemplary method of preventing movement of forkbolt 24 during a predetermined event is provided. In this exemplary method, contact feature 32 of detent 26 engages with shoulder 28 of forkbolt 24 as illustrated in FIG. 3. Alternatively, contact feature 32 of detent 26 engages with shoulder 30 of forkbolt 24 as illustrated in FIG. 4. Next, sensor 64 detects one or more variables during one or more predetermined events. Sensor 64 sends a signal to electronic control module 60 when one or more variables are detected. Then, electronic control module 60 determines whether or not the one or more variables exceed the locking threshold. If one or more variables exceed the locking threshold, the electronic control module 60 provides an amount of voltage to activation mechanism 54. In doing so, activation mechanism 54 deforms to a length less than its original length. In response to the shortening of activation mechanism 54, output force is temporarily applied to second arm 46 of block out mechanism 40. At this time, block out mechanism 40 overcomes the biasing force of block out return spring 52. Block out mechanism 40 then moves into the blocking position for a predetermined time period as illustrated in FIG. 4. As a result, block out mechanism 40 prevents forkbolt 24 from moving from the latching position by having a periphery portion of first arm 44 abut against a periphery portion of ear 50 of detent 26. After the predetermined time period, activation mechanism 54 conforms back to its original length and block out mechanism 40 moves to the unblocking position by the biasing force of the block out return spring 52 as illustrated in FIG. 5. When activation mechanism 54 conforms back to its original length, detent 26 freely rotates counterclockwise to the releasing position and disengages with forkbolt 24. Likewise, forkbolt freely rotates counterclockwise to the unlatching position.

In an alternative exemplary embodiment, and as illustrated by the dashed lines in FIG. 4, activation mechanism 54 is any one of a motor, hydraulic actuator, vacuum actuator, rotary or linear actuator that provides the required force to move the block out mechanism to the blocking position and thereafter the biasing spring returns the block out mechanism to unblocking position after the biasing force of the activation mechanism has been removed. In accordance with one exemplary embodiment of the present invention, the time to move the block out mechanism from the unblocking position to the blocking position by the activation mechanism is less than the time to move the block out mechanism from the blocking position to the unblocking position by the biasing member.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A vehicle door latch system, comprising:

a forkbolt pivotally mounted to a housing portion of the vehicle door latch system, the forkbolt being capable of movement between a latching position and an unlatching position;

a detent lever pivotally mounted to the vehicle door latch system, the detent lever capable of moving between an engaged position, wherein the detent lever prevents movement of the forkbolt from the latching position to the unlatching position and a disengaged position, wherein the detent lever does not prevent movement of the forkbolt from the latching position to the unlatching position;

a block out mechanism configured for movement between a blocking position and an unblocking position, the block out mechanism being configured to prevent the detent lever from moving from the engaged position to the disengaged position when the block out mechanism is in the blocking position, the block out mechanism being biased into the unblocking position by a biasing member, wherein the block out mechanism does not prevent movement of the detent lever to the disengaged position when the block out mechanism is in the unblocking position;

an activation mechanism comprising a shape memory alloy operatively connected to the block out mechanism for moving the block out mechanism to the blocking position by overcoming a biasing force of the biasing member, wherein the activation mechanism maintains the block out mechanism in the blocking position for a predetermined time period;

an electronic control module configured to provide a voltage to the shape memory alloy, wherein the voltage causes the shape memory alloy to contract from a first dimension to a second dimension, the second dimension being less than the first dimension; and at least one sensor for detecting at least one variable during at least one predetermined event, the at least one sensor being configured to generate a signal for receipt by the electronic control module, the signal corresponding to the at least one variable, wherein the electronic control module provides the voltage to the shape memory alloy when the at least one variable exceeds a locking threshold.

2. The vehicle door latch system as in claim 1, wherein the block out mechanism is moved to the unblocking position by the biasing member after the predetermined time period has elapsed.

3. The vehicle door latch system as in claim 1, wherein a first contact feature of the detent lever engages with at least one shoulder of the forkbolt when the detent lever is in the engaged position.

4. The vehicle door latch system as in claim 1, wherein an arm of the block out mechanism abuts a peripheral surface of a second contact feature defined of the detent lever when the block out mechanism is in the blocking position.

5. The vehicle door latch system as in claim 1, wherein the at least one sensor is an accelerometer.

6. The vehicle door latch system as in claim 5, wherein the locking threshold is a predetermined G-force and the accelerometer is located in a portion of the vehicle.

7. The vehicle door latch system as in claim 1, wherein the shape memory alloy is formed from at least one of the following alloys: Copper-Zinc Aluminum alloys; Copper-Aluminum-Nickel alloys; Nickel-Titanium alloys; or a combination thereof and the shape memory alloy is configured into a wire.

8. The vehicle door latch system as in claim 1, wherein the shape memory alloy is secured to a portion of the housing portion at one end and a portion of the block out mechanism at another end, wherein the first dimension corresponds to the block out mechanism being in the unblocking position, and wherein the detent lever is prevented from moving from the engaged position for a predetermined time period by temporarily overcoming the biasing member when the voltage is applied to the shape memory alloy, the shape memory alloy being configured to maintain the block out mechanism in the block out position for the predetermined time period after the voltage has been removed from the shape memory alloy, and wherein the block out mechanism moves to the unblocking position by the biasing member after the predetermined time period.

9. The vehicle door latch system as in claim 8, wherein the shape memory alloy is configured as a wire and the wire is formed from at least one of the following alloys: Copper-Zinc Aluminum alloys; Copper-Aluminum-Nickel alloys; Nickel-Titanium alloys; or a combination thereof.

10. The vehicle door latch system as in claim 1, wherein a first contact feature of the detent lever engages with at least one shoulder of the forkbolt when the detent lever is in the engaged position.

11. The vehicle door latch system as in claim 10, wherein an arm defined of the block out mechanism abuts a peripheral surface of a second contact feature defined of the detent lever when the block out mechanism is in the blocking position.

12. A method for preventing movement of a forkbolt pivotally mounted to a housing portion of a vehicle door latch, the method comprising:

biasing a block out mechanism into an unblocking position by a biasing member, the block out mechanism allowing a detent lever to move from an engaged position to a disengaged position when the block out mechanism is in the unblocking position, wherein the forkbolt can move between a latching position and an unlatching position when the detent lever is in the disengaged position; and moving the block out mechanism into a blocking position for a predetermined time period by temporarily overcoming a biasing force of the biasing member by applying a voltage to a shape memory alloy operatively coupled to the block out mechanism, wherein the voltage causes the shape memory alloy to constrict in size when the voltage is applied and wherein the shape memory alloy returns to an un-constricted size a predetermined time period after removal of the voltage from the shape memory alloy, and the block out mechanism moves to the unblocking position by the biasing member after the predetermined time period, wherein an electronic control module applies the voltage when at least one sensor detects at least one variable during at least one predetermined event, the at least one sensor being configured to generate a signal for receipt by the electronic control module, the signal corresponding to the at least one variable, the electronic control module being configured to apply the voltage when the at least one variable exceeds a locking threshold.

13. The method as in claim 12, wherein the shape memory alloy is secured to a portion of the housing portion at one end and a portion of the block out mechanism at another end.

14. The method as in claim 12, wherein the shape memory is configured to maintain the block out mechanism in the block out position for the predetermined time period after the voltage has been removed from the shape memory alloy, and wherein the block out mechanism moves to the unblocking position by the biasing member after the predetermined time period.

15. The method as in claim 12, wherein the shape memory alloy is formed from at least one of the following alloys: Copper-Zinc Aluminum alloys; Copper-Aluminum-Nickel alloys; Nickel-Titanium alloys; or a combination thereof and wherein the shape memory alloy is a wire.

16. A method for preventing movement of a forkbolt pivotally mounted to a housing portion of a vehicle door latch, the method comprising:

biasing a block out mechanism into an unblocking position by a biasing member, the block out mechanism allowing a detent lever to move from an engaged position to a disengaged position, wherein the forkbolt is free to from a latching position to an unlatching position when the detent lever is in the disengaged position;

detecting the occurrence of at least one variable during at least one predetermined event by at least one sensor;

sending a signal to an electronic control module when the at least one variable during the at least one predetermined event is detected to cause a shape memory alloy to constrict in size by applying a voltage to the shape memory alloy, the electronic control module being configured to apply the voltage when the electronic control module determines that the at least one variable has occurred during the at least one predetermined event; and wherein the shape memory alloy moves the block out mechanism into a blocking position, wherein the detent lever is prevented from moving from the engaged position for a predetermined time period by temporarily overcoming the biasing member when the voltage is applied to the shape memory alloy, the shape memory alloy being configured to maintain the block out mechanism in the block out position for a predetermined time period after the voltage has been removed from the shape memory alloy, and wherein the block out mechanism moves to the unblocking position by the biasing member after the predetermined time period.

* * * * *